United States Patent [19]

Yasuda

[11] Patent Number: 4,692,347

[45] Date of Patent: Sep. 8, 1987

[54] METHOD OF INTERIORLY COATING TUBING

[75] Inventor: Hirotsuga K. Yasuda, Newburg, Mo.

[73] Assignee: The Curators of the University of Missouri, Columbia, Mo.

[21] Appl. No.: 689,934

[22] Filed: Jan. 9, 1985

Related U.S. Application Data

[63] Continuation of Ser. No. 511,461, Jul. 7, 1983, abandoned.

[51] Int. Cl.[4] ..... B05D 3/06

[52] U.S. Cl. ..... 427/40; 427/41; 427/177; 427/237; 427/238; 427/296

[58] Field of Search ..... 427/40, 41, 237, 238, 427/296, 177

[56] References Cited

U.S. PATENT DOCUMENTS 4,072,769 2/1978 Lidel ..... 427/40
4,145,456 3/1979 Kuppers et al. ..... 427/38

FOREIGN PATENT DOCUMENTS 4056672 5/1979 Japan ..... 427/40

OTHER PUBLICATIONS

H. Yasuda and Toshihiro Hirotsu, Distribution of Polymer Deposition in Plasma Polymerization. I. Acetylene, Ethylene, and the Effect of Carrier Gas, Journal of Polymer Science: Polymer Chemistry Edition, vol. 16, 229–241 (1978).

H. Yasuda and Toshihiro Hirotsu , Distribution of Polymer Deposition in Plasma Polymerization. II. Effect of Reactor Design, Journal of Polymer Science: Polymer Chemistry Edition, vol. 16, 313–326 (1978).

H. Yasuda and N. Morosoff, Plasma Polymerization of Tetrafluorethylene. I. Inductive Radio Frequency Discharge, Journal of Applied Polymer Science, vol. 23, 1003–1011 (1979).

*Primary Examiner*—Bernard D. Pianalto

*Attorney, Agent, or Firm*—Senniger, Powers, Leavitt and Roedel

[57] ABSTRACT

A method and apparatus for providing a thin substantially uniform polymeric coating on the inside surface of tubing. Tubing constituted of dielectric material is passed through a glow discharge zone in which the glow discharge is produced by reactance coupling utilizing power provided by a radio frequency power source. Simultaneously with the movement of the tubing through the glow discharge zone, a monomer that is subject to glow discharge polymerization is passed through the glow discharge zone in the interior of the tubing, while a low absolute pressure is maintained in the interior within the zone. Glow discharge polymerization of the monomer is thereby effected to form a thin polymeric coating on the inside surface of the tubing.

Also disclosed is a novel tubing constituted of dielectric material and having on the inside surface thereof a thin adherent, substantially uniform coating produced by glow discharge polymerization. Further disclosed is a vascular prosthesis having a barrier layer on the inside surface thereof produced by glow discharge polymerization.

6 Claims, 16 Drawing Figures

METHOD OF INTERIORLY COATING TUBING

This is a continuation of application Ser. No. 511,461, filed July 7, 1983 now abandoned.

BACKGROUND OF THE INVENTION

This invention relates to coating of the interior walls of tubing constituted of plastic or other dielectric material, and, more particularly, to improved methods and apparatus for depositing a thin but substantially uniform and adherent polymeric coating on the interior surfaces of such tubing, and the coated tubing thereby produced.

Plastic tubing, most particularly that constituted of silicone rubber, is used as a blood conduit in various applications such as blood dialysis units and heart/lung machines utilized in open-heart surgery. In such applications, problems may potentially arise due to interactions between the blood and the plastic tubing wall. Some types of tubing, such as, for example, polyvinyl chloride, typically contain processing aids or other components which are susceptible to being leached from the tube wall into the blood stream, with potential adverse physiological effects on a patient to whose system the blood is delivered through the tubing. Additionally, or alternatively, certain plastic tubing materials such as silicone rubber may absorb or "imbibe" components of the blood into the tubing wall. These phenomena can present problems not only in blood transmission but also where tubing is used as a conduit for other materials, for example, glucose or physiological saline solution for intravenous administration.

The problems of leaching and imbibition can be potentially eliminated by the application of a barrier coating on the inside surface of the tubing. However, there are significant technical obstacles to applying a coating having the combination of properties desirable for a barrier coating over the inside tubing surface. Such a coating must be very thin and preferably conform closely to the macroscopic topography of the tubing surface. It should adhere tightly and reliably to the substrate material, and be highly flexible and tough so that it does not limit the flexibility of the tubing.

Preservation of the macroscopic topography of the inside tubing surface is particularly important in the practical evaluation of surface/blood interaction. Certain methods of surface modification such as graft copolymerization, which may otherwise be effective for providing a barrier layer, tend to alter surface topography as well as surface chemical properties. As a result, it becomes difficult to separate the influence of chemical modification from that of physical modification in evaluating the effect on blood/surface interaction.

Blood/surface interactions may limit the suitability of a particular tubing for use as a conduit for blood. Thus, for example, tubing that is knitted or woven from synthetic polymeric fibers is conventionally used as a vascular prosthesis for replacement of large arteries, such as the aorta. After implantation, tissue growth through the woven structure provides a natural surface over which the blood flows. However, such knitted or woven tubing is generally not suitable for replacement of smaller vessels, since tissue ingrowth or thrombogenic reactions may cause it to become obstructed. Certain plastic materials may be suitable as an athrombogenic inner coating on a knitted prosthesis, but problems of leaching and imbibition need also be addressed.

Attempts have been made to provide barrier coatings for the interior of plastic tubing by depositing a polymer coating produced by glow discharge (plasma) polymerization on the inside tube surface. However, using conventional glow discharge polymerization apparatus, it has been found to be almost impossible to uniformly coat the inner surface of small diameter plastic tubing. For example, when tubing 3 mm to 6 mm I.D., having a length to diameter ratio of 100 or greater, is placed in a large plasma reactor, the plasma does not penetrate inside the tubing Instead, the plasma is quenched near the ends of the tubing and only small portions of the interior surface near the ends become coated. By utilizing a small glass tube reactor, it has been found that the plasm may be forced to penetrate into the interior of the tubing, thereby making it possible to provide a coating on the inside wall of tubing having a length of one meter or longer. However, the coating produced in this manner is found to vary along the length of the tubing with respect to both thickness and chemical nature of the plasma polymer. This results from the inherent difficulty of providing an even supply of monomer to all of the surface to be coated, and from the relative location of the glow discharge in the monomer flow. See, H. Yasuda and T. Hirotsu, *J. Polym. Sci., Polym. Chem. Ed.*, 16, 229 (1978); H. Yasuda and T. Hirotsu, *J. Polym. Sci., Polym. Chem. Ed.*, 16, 313 (1978); and, H. Yasuda and N. Morosoff, *J. Appl. Polym. Sci.*, 23, 1003 (1979). Although glow generally extends along a considerable length of tubing, most polymerization occurs at the tip of the glow against monomer flow, and not enough monomer can be supplied to the downstream portion of the tube. Thus, monomer consumption and the extent of polymer deposit varies significantly along the tubing length.

Other methods of depositing a very thin polymeric coating generally lead to the formation of a spotty deposit containing significant areas which are uncoated, so that in the case of coated tubing, the substrate surface is exposed to the fluids for which the tubing serves as a conduit. Accordingly, a need has remained in the art for a method for depositing a thin, substantially uniform coating that is free from defects or apertures on the inside surface of the tubing.

SUMMARY OF THE INVENTION

Among the several objects of the present invention, therefore, may be noted the provision of a novel method for depositing a polymeric coating on the inside surface of tubing constituted of plastic or other dielectric material; the provision of such a method which provides a coating which is thin but substantially uniform and free from the defects that otherwise allow contact between the material constituting the tubing wall and the fluid passed through the tubing; the provision of such a method which provides a coating which is substantially uniform in thickness; the provision of such a method which provides a coating which conforms closely to the inside surface of the tubing, and therefore, does not alter its macroscopic topography; the provision of such a method which provides a coating that is strongly adherent to the inside tubing surface; the provision of such a method which provides a coating which is tough and flexible; the provision of such a method which produces a coating constituting a barrier against leaching of components from the tubing wall by a fluid passed therethrough or imbibition of components of the fluid into the tubing wall; the provision, alternatively, of coatings which may serve as semipermeable membranes for molecular separation; the provision of a method for producing a vascular prosthesis; the provision of apparatus useful in practicing the aforesaid methods; and, the provision of novel tubing produced thereby.

Briefly, therefore the present invention is directed to a method for providing a thin, substantially uniform polymeric coating on the inside surface of tubing. In this method, tubing constituted of dielectric material is passed through a glow discharge zone, the glow discharge being produced by reactance coupling utilizing power provided by a radio frequency power source. Simultaneously with the movement of the tubing through the glow discharge zone, a monomer subject to glow discharge polymerization is passed through the glow discharge zone in the interior of the tubing, while a low absolute pressure is maintained in said interior within said zone. Glow discharge polymerization of the polymer is thereby effected and a thin, polymeric coating is formed on the inside surface of the tubing.

The invention is further directed to an apparatus for providing a thin, substantially uniform polymeric coating on the inside surface of tubing. The apparatus includes a glow discharge polymerization chamber containing electric reactor means, the reactor means being adapted for connection to a radio frequency power source for reactance coupling upon application of power from such source, means for passing the tubing through a zone in which glow discharge is created in the polymerization chamber upon application of radio frequency power from the source, means for communication between the interior of the tubing and a first evacuation means, means for communication between the interior of the tubing and a source of monomer subject to glow discharge polymerization, and means for communication between a second evacuation means and the region of the chamber outside the tubing.

The invention is further directed to tubing comprised of dielectric material and having a thin, adherent substantially polymeric coating on the inside surface thereof. The coating is produced by glow discharge polymerization.

The invention is further directed to a vascular prosthesis comprising a tube constituted of synthetic textile fabric and having on the inside wall thereof a coating comprising a resin film. The inside surface of the resin film has a thin adherent substantially uniform polymeric barrier layer thereon. The barrier layer is produced by glow discharge polymerization and is effective to inhibit both leaching of components of the resin film by blood passing through the prosthesis and imbibition by the film of components of the blood.

Other objects and features will be in part apparent and in part pointed out hereinafter.

DESCRIPTION OF THE PREFERRED EMBODIMENTS

Figure 1:
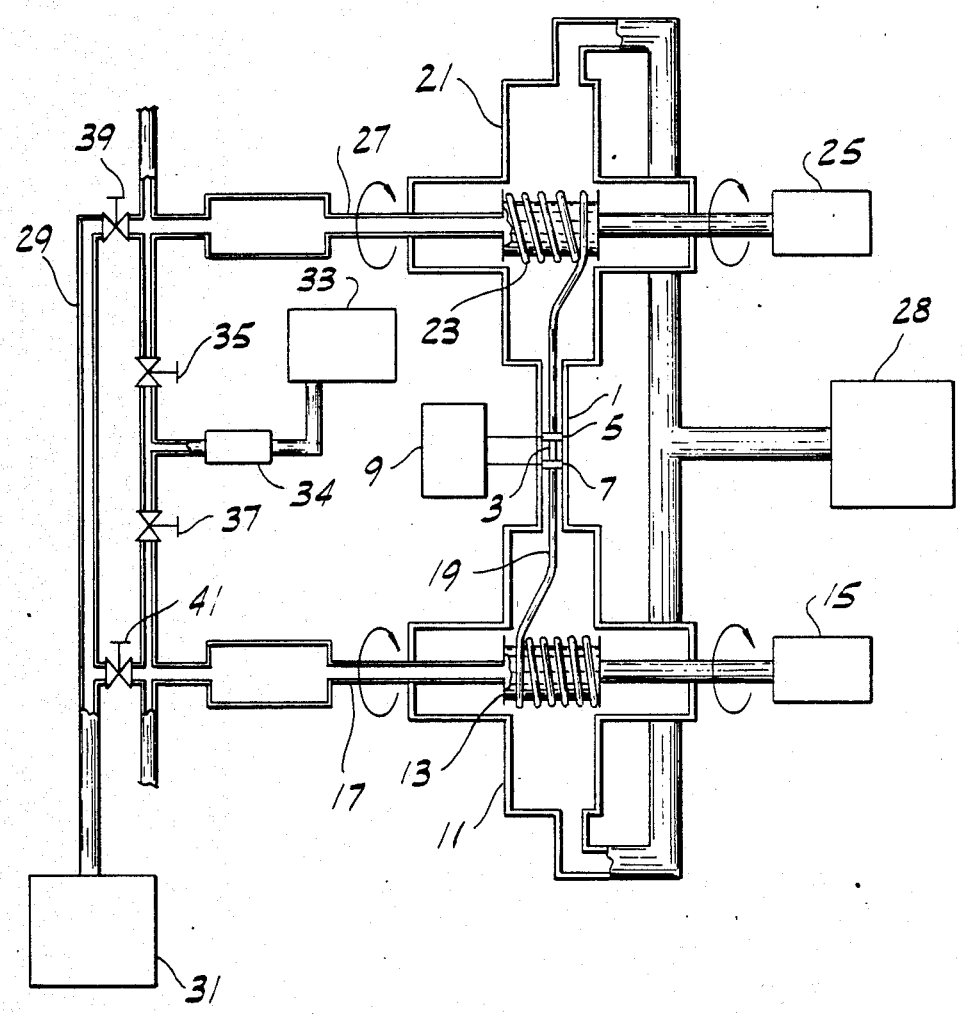
FIG. 1 is a schematic illustration of the apparatus of the invention.

In accordance with the present invention, it has been found that a thin, adherent and substantially uniform coating can be produced on the interior surface of plastic tubing by a novel process in which the tubing is moved continuously through a stationary glow discharge zone. By this unique stratagem the method of the invention avoids the problem of preferential deposit of monomer near the ends of the tube, a problem which has generally characterized other methods by which coating of the interior surface of plastic tubing has been attempted. Moreover, the method of the invention is adapted for the application of a uniform polymer coating on the interior surface of tubing of substantial length. The coating obtained is strongly adherent to the tubing wall and, because of its uniformity, the coating may constitute a barrier layer which is essentially free of defects, yet very thin so that it does not alter the surface morphology of the interior of the tubing. Thus, the coating conforms closely to the macroscopic topography of the interior tubing surface. This feature affords a significant advantage in the development of interiorly coated tubings for various applications since preservation of surface morphology allows discrimination between the effects of morphology and surface chemistry in the evaluation of tubing performance.

Because uniform, defect-free impermeable polymeric layers can be deposited in accordance with the method of the invention, the method allows the preparation of tubing having a barrier layer effective for preventing both leaching from the tubing wall of the components of the plastic material of which the tubing is constituted and imbibition into the tubing wall of components of a fluid passed through the tubing. Moreover, because of the high degree of uniformity of the coating produced, such barrier properties can be realized in coatings which are so thin as not to alter the flexure properties of even such flexible tubings as those constituted of silicone rubber.

In accordance with the method of the invention, the interior of the tubing is connected to an evacuation means and pumped down to a low absolute pressure. A glow discharge zone is produced within a polymerization chamber by reactance coupling, utilizing power provided by a radio frequency power source. Either inductive coupling or capacitance coupling may be used. The glow discharge zone is preferably maintained stationary and the tubing to be coated is passed continuously through the glow discharge zone. Simultaneously with the movement of the tubing through the zone, a monomer subject to glow discharge polymerization is passed through the glow discharge zone in the interior of the tubing while a low absolute pressure is maintained therein. Glow discharge (plasma) polymerization is thereby effected, causing the formation of an amorphous polymer which deposits as a thin, highly uniform layer which is strongly adhered to the tubing wall substrate.

A variety of conventional monomers can be used in providing a coating in accordance with the method of the invention. Thus, a conventional olefin can be used, such as ethylene, propylene, butene, and the like. Under glow discharge conditions, however, it is also feasible to polymerize alkanes such as ethane and propane. For application of a barrier coating on the inside surface of plastic tubing that is adapted for service in transmission of blood or other physiological fluids, halogenated monomers such as hexafluoroethane and tetrafluoroethylene are especially suitable.

Although it is normally preferred that the monomer be a gas under the conditions of plasma polymerization, it is also possible to carry out the polymerization utilizing a liquid monomer flowing along the substrate wall, with the plasma being generated in an inert gas flowing through the tube.

The composition and properties of the glow discharge polymerization product may be altered by the use of a comonomer. Hydrocarbons and halogenated hydrocarbon monomers of the type discussed above may be utilized as comonomers. Various gases such as hydrogen, ammonia, carbon monoxide, nitrogen and sulfur dioxide are also reactive under glow discharge polymerization conditions for copolymerization with hydrocarbon and substituted hydrocarbon type monomers. The use of a comonomer such as hydrogen is particularly advantageous, for example, in the polymerization of such substituted hydrocarbons as hexafluoroethane which do not readily homopolymerize even under glow discharge reaction conditions. However, it has been found that the addition of hydrogen is not as critical in the relatively compact reaction zone involved in application of the method of the invention to the coating of the interior of small diameter tubing, for example, 3 mm to 6 mm I.D. It is believed that effective polymerization of otherwise relatively nonreactive monomers may result from the high surface to volume ratios in the glow discharge zone, whereby sufficient supply of hydrogen atoms is provided by plasma attack on the plastic tubing substrate.

Illustrated schematically in FIG. 1 is a novel apparatus adapted for use in carrying out the method of the invention. Tubular polymerization chamber 1 contains a capacitor 3 comprising electrode plates 5 and 7 which are connected to opposite terminals of a radio frequency generator 9. Thus, a glow discharge zone may be established between the electrodes of the capacitor. Orientation of the electrode plates of the capacitor may alternatively be transverse to the tubing within the chamber. Also, as indicated above, the electric reactor may comprise an inductor rather than a capacitor.

One end of tubular chamber 1 is connected to a feed chamber which comprises a glass cross 11 containing a hollow feed reel 13 that is axially attached at one end to the shaft of a variable speed motor 15 and is connected at the other end in communication with a conduit 17. Conduit 17 is adapted for communication with either an evacuation means or a monomer source as described hereinbelow.

Tubing 19 to be coated is initially wound on reel 13 with the innermost end of the tubing in communication with conduit 17 via an aperature (not shown) in reel 13.

A receiving chamber comprising a glass cross 21 is connected to the end of tubular chamber 1 opposite the cross 11. Cross 21 contains a hollow receiving reel 23, upon which tubing whose interior wall has been coated in the polymerization chamber is wound. One end of reel 23 is axially attached to the shaft of variable speed motor 25 and the other end of reel 23 is axially connected in communication with a conduit 27. Feed chamber 11, polymerization chamber 1 and receiving chamber 21 are all in communication with an evacuation means 29 for evacuating those regions of the chamber outside of the tubing 19, reels 13 and 23, and conduits 17 and 27.

A manifold 31 interconnects an evacuation means 31 and a monomer source 33 with conduit means 17 and 27 to provide for a supply of monomer to, and the establishment of a low absolute pressure in, the interior of tubing 19. A flow controller 34 is located in the supply line downstream of source 33. A set of block valves 35, 37, 39, and 41 allows for monomer flow to be oriented in a direction either cocurrent with or countercurrent to the direction of movement of tubing 19 through the glow discharge zone 3.

In operation of the apparatus of FIG. 1, tubing initially wound on reel 13 is threaded through polymerization chamber 1 via axially aligned holes (not shown) in electrode plates 5 and 7. The tubing is pulled into receiving chamber 21 and attached to receiving reel 23. The interior of tubing 19 is evacuated and monomer flow initiated through the tubing. For cocurrent flow of monomer and tubing, valve 35 and 41 are closed, valve 39 is opened, the interior of the tubing is evacuated through conduit 27 and valve 39, and valve 37 is opened to admit monomer gas through conduit 17, the interior of reel 13, and thence into the tubing. For countercurrent monomer flow, valves 37 and 39 are closed, valve 41 opened for evacuation of the tubing via conduit 17, and valve 35 opened to admit flow of monomer through conduit 27.

Prior to initiation of glow discharge polymerization on the interior tubing wall, the regions of chambers 11, 1, and 21 outside of the tubing are evacuated through evacuation means 28. If desired, a monomer may also be caused to flow through the regions outside the tubing to provide for coating the outside as well as the inside. Motors 15 and 25 are operated to pull the tubing through the chamber 1, preferably at constant linear velocity. Glow discharge polymerization is then carried out in the manner described more fully below.

Figure 2:
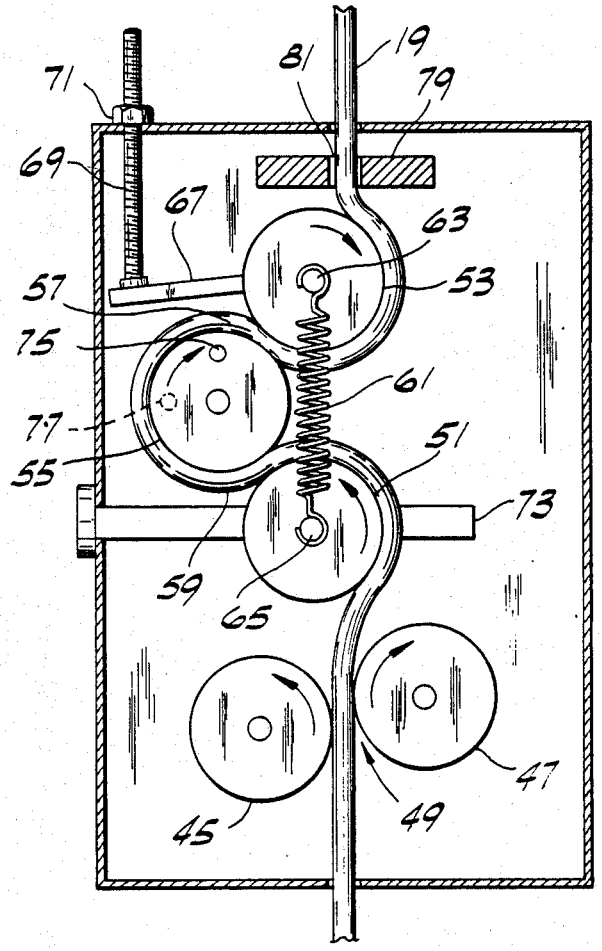
FIG. 2 is a schematic illustration of a device adapted to be incorporated in the apparatus of FIG. 1 for use in adjusting tubing tension and measuring winding speed of the tubing pulled through the apparatus.

Illustrated in FIG. 2 is a device adapted to be interposed between reel 23 and tubular polymerization chamber 1 for controlling the pulling tension and measuring the winding speed in operation of the apparatus of FIG. 1. This device includes a pair of guide wheels 45 and 47 positioned to provide a nip 49 therebetween along the line of travel of tubing entering the device. The tensioning system comprises a combination of pulleys 51 and 53, which are diametrically aligned in the direction of travel of the tubing, and a pulley 55 whose axis is laterally offset from the direction of tubing travel and which is positioned to provide a narrow nip 57 between its periphery and the per:.phery of pulley 53 for gripping the tubing 19. Another nip 59 between the periphery of pulley 51 and that of pulley 55 allows free passage of the tubing. A tensioning spring 61 is attached at one end to the axis 63 of pulley 53 and at the other end to the axis 65 of pulley 51, and provides a bias urging movement of pulley 53 towards pulley 51, the axis 65 of the latter being fixed. The movement of pulley 51 towards pulley 53 is restrained and the position of pulley 51 controlled via a lever 67 having one end attached to axis 63 and the position of the other fixedly adjustable via an adjustment bolt 69, which is threadably engaged in a nut 71 whose position is fixed. Tension in spring 61 as imparted to axis 65 is measured by tension gauge 73.

Pulley 55 has a hole 75 therein which is located for alignment with a phototransistor 77 at a particular angular orientation of pulley 55.

A guide 79 has a hole 81 therein aligned with the direction of travel of tubing 19 and through which the tubing is threaded downstream of the tensioning device.

In operation of the tensioning device of FIG. 2, the tubing is threaded through nip 49 between pulleys 45 and 47, over pulley 51, through nip 59 between pulley 51 and pulley 55, over pulley 55, through nip 57 between pulley 55 and pulley 53 and through aperature 81 in guide 79. By the biasing force of spring 61, pulley 53 is caused to exert pressure on tubing 19 in the nip 57, thereby exerting a retarding force on the travel of the tubing through the nip, and tensioning the tubing on the downstream side of pulley 53 as the tubing is pulled through the tensioning device. The degree of force exerted on the tubing by pulley 53 at nip 55 is controlled by adjustment of the location of axis 63 of pulley 53 as determined by the position of bolt 69 and lever 67. The position of bolt 69 is established at the point at which tension gauge 73 indicates the desired tension in spring 61.

As tubing is drawn through the device of FIG. 2, pulley 55 turns at a peripheral speed equal to the linear speed of the tubing. On each revolution of pulley 55, light passing through hole 75 activates the phototransistor 77 and, by counting the frequency of such activation, the linear speed of tubing through the apparatus can be measured and controlled.

In accordance with the method of the invention, the tubing to be coated is wrapped around feed reel 13 and the entire system is evacuated to establish low absolute pressure both on the inside and outside of the tubing, preferably $10^{-1}$ torr or less, typically approximately $10^{-3}$ torr. Monomer gas at low pressure is admitted to the system via either conduit 17 or conduit 27. Because of the pressure drop resulting from flow, the pressure varies along the length of tubing but is typically in the range of 100 mtorr and 1 torr, preferably about 300 mtorr and 900 mtorr at capacitor 3 in chamber 1. Pressure drop over the entire length of tubing depends on tubing length, monomer flow, and tubing diameter but, for a 50-foot length of tubing, inlet pressure is typically in the range of 2 torr to 3 torr, and outlet pressure in the range of 1 mtorr to 10 mtorr.

Power is applied to capacitor 3 by operation of generator 9. Once power has been applied and monomer flow established, glow discharge polymerization is initiated by means of a Tesla coil. Power applied by generator 9 should be in the radio frequency range. For purposes of effecting glow discharge polymerization, precise frequency is not critical, but generally should be at least about 500 kHz. To avoid creating radio interference, however, the power source should be operated at a frequency that is assigned for industrial or scientific use, such as, for example, 13.5 mHz. Control of deposition rate and thickness of coating is obtained by adjustment of monomer flow rate, linear speed of the tubing through the reaction chamber, length-to-diameter ratio of the glow discharge zone inside the tubing, and power input.

The length-to-diameter (lateral dimension) ratio should be in the range of 2 to 100, preferably about 4 to about 10. Linear velocity of tubing through the glow discharge zone is conveniently in the range of 5 cm to 50 cm per minute, preferably 12 cm to 30 cm per minute, varying somewhat with the identity of the monomer utilized. Residence time in the glow discharge zone (coating time) is preferably four to ten seconds.

Power input may vary widely. For 3 mm to 6 mm diameter tubing coated at linear tubing speeds in the ranges discussed above, power input may typically be in the range of 3 watts to 50 watts. However, energy input per unit mass of monomer is a significant parameter in determining the character of the polymeric coating obtained. Thus, for example, where W = Power Input (in watts)

F = Flow Rate (in moles per second)

M = Molecular Weight of Monomer a tight amorphous polymeric layer effective as a barrier layer is obtained where $$\frac{W}{FM} = 10^9 \text{ to } 10^{10} \text{ J/kg}$$

and a relatively permeable coating is obtained where $$\frac{W}{FM} = 10^7 \text{ to } 10^8 \text{ J/kg}$$

Thickness of the glow discharge polymeric coating may range from 50 A to 1000 A, but for purposes of service as a barrier coating, the thickness is preferably in the range of 100 A to 500 A. At thicknesses significantly greater than about 1000 A, the coatings have a tendency to suffer from stress cracking.

Deposition rates attainable in the method of the invention are substantially higher than those normally achieved by other methods for glow discharge polymerization coating of the inside surfaces of plastic tubing. For effective control at moderate linear velocities of tubing through the discharge zone, deposition rates are preferably controlled in the range of between about 0.001 and about 0.01 m/sec. Based on theoretical calculations, the deposition rates obtained in accordance with the method of the invention may be even higher, in fact significantly higher, than the rates which are preferred. Actual deposition rates, while higher than those achieved by other methods, are not as high as theoretical rates, and usually can be controlled within the desired range by adjustment of operating parameters. However, to control the deposition rate, it may in some instances be desirable to include a diluent in the monomer gas stream fed to the interior of the tubing, thereby retarding the deposition rate and effecting more positive control over the thickness of the glow discharge polymer coating. Diluents suitable for use in this fashion are essentially limited to inert gases such as helium, neon, and argon. As indicated above, gases such as nitrogen and carbon monoxide, which are inert in conventional chemical reaction systems, are reactive as comonomers under the glow discharge conditions utilized in the method of the invention.

Although the method of the invention is particularly effective for the application of a barrier coating to the interior wall of plastic tubing, the method may also be used for providing very thin plasma polymerization coatings which may serve, for example, as a semipermeable membrane for use in carrying out molecular separations. In any event, the method of the invention produces a novel product comprising tubing of dielectric material having a thin adherent substantially uniform polymeric coating on the inside surface thereof.

As indicated above, the dielectric material of which the tubing is constituted preferably comprises a plastic and, more preferably, a relatively flexible plastic such as silicone rubber. Other suitable materials include polyvinyl chloride, nylon, polyethylene, ethylene/vinyl acetate, acrylics, various synthetic rubbers, polyesters and the like. Although primarily adapted for coating the interior walls of plastic tubing, the method of the invention is also effective for coating the inside of tubing comprised of other dielectric materials such as, for example, glass. Thus the novel product of the invention may be embodied in tubing of glass, ceramic or other inorganic dielectric material interiorly coated with a polymeric layer produced by glow discharge polymerization.

Figures 3, 4, 5:
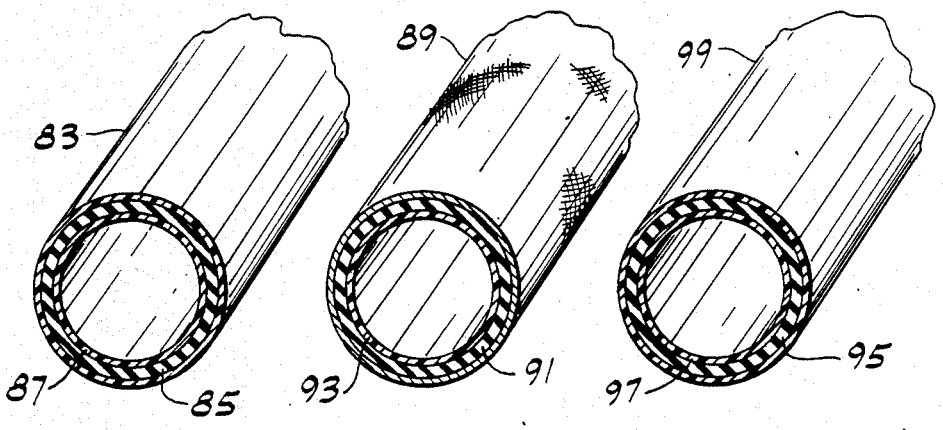
FIG. 3 is an illustration of the coated tubing of the invention.
FIG. 4 is an illustration of a vascular prosthesis that may be produced in accordance with the invention.
FIG. 5 illustrates an alternative construction for a vascular prosthesis of the invention.

The product of the invention, as illustrated in FIG. 3, comprises tubing 83 constituted of dielectric material. On the inside surface of the tubing is a thin, adherent, substantially uniform polymeric coating 85 that has been produced as described above by glow discharge polymerization. Optionally, the tubing has a second glow discharge polymerized layer 87 on its outside surface which may serve, for example, as an antifriction layer. The tubing of the invention is suitable for use as a conduit for blood in dialysis units, heart-lung machines and the like. It is also suitable as a conduit for delivery of other physiological materials such as nutrient solutions and saline solutions containing antibiotics or other medicaments for intravenous administration.

In a particularly advantageous application, the method of the invention may be used to produce a novel vascular prosthesis of the type illustrated in FIG. 4. This prosthesis is comprised of a tube 89 constituted of synthetic textile fabric having on the inside wall thereof a coating 91 comprised of a resin film. Preferably film 91 comprises an elastomeric material such as, for example, silicone rubber, so that a maximum of flexibility is preserved in the prosthesis. On the inside surface of resin film 91 is a thin adherent substantially uniform polymeric barrier layer 93 produced by glow discharge polymerization. The barrier layer is effective to inhibit both leaching of components of the resin film from blood passing through the prosthesis and imbibition by the film of components of the blood.

In the preparation of the prosthesis of the type illustrated in FIG. 4, conventional knitted or woven fabric tubing is first coated on its inside wall with resin film 85 utilizing a conventional coating method such as, for example, solution coating. After resin film 91 is established on the interior wall of tube 89, application of the barrier layer 93 may be carried out, for example, by use of the apparatus of FIG. 1.

The prosthesis illustrated in FIG. 4 is particularly suitable for use in replacement of small arteries. By use of a monomer which produces an athrombogenic barrier coating, even a very small diameter prosthesis can be used in vivo without formation of the obstructions that may otherwise result from clotting or tissue ingrowth in a small diameter prosthesis consisting only of textile fabric. At the same time the prosthesis of the invention is essentially immune to the leaching or imbibition problems that may be associated with a tubular fabric prosthesis having only an inside coating of a resin such as polyvinyl chloride or silicone rubber. To provide an athrombogenic plasma polymerized barrier coating, the monomer used is preferably a fluorocarbon such a tetrafluoroethylene or hexfluoroethane.

Preferably, the barrier layer 93 of the prosphesis conforms to the interior surface of resin film 91 so as not to affect the macroscopic topography of the resin film. As discussed above, the thickness of the barrier layer should be in the range of 50 to 1,000 A, preferably 100 to 500 A. Thus, the flexibility of the prosthesis is not adversely altered by the presence of the glow discharge polymerized barrier layer.

In an alternative embodiment of the vascular prosthesis, as illustrated in FIG. 5, a plasma polymerization layer 95 is deposited directly on the inside wall of a textile fabric tube 97, with no intermediate resin layer. In this embodiment, the tube is preferably of relatively tightly-woven fabric so as to facilitate sealing of the pores thereof with the glow discharge layer 95. Optionally, another glow discharge polymerization layer 99 may be applied over the outside surface of tube 97.

In order to maintain the maximum of uniformity in the glow discharge polymerization coating, it is preferred that the tubing be drawn through the reaction zone at a constant linear velocity and that power input, monomer flow rate and pressure be maintained essentially constant during the coating process. A uniformly coated tubing of predetermined length may thus be produced.

The following examples illustrate the invention.

EXAMPLE 1

Silastic silicone rubber tubing having a 3.3 mm I.D. and a 4.6 mm O.D. was interiorly coated using an apparatus of the type illustrated in FIG. 1. In the apparatus used, the hollow cores of reels 13 and 23 were connected to the vacuum system through $\frac{3}{4}''$ stainless steel tubing and the other ends of the reels were attached through $\frac{3}{4}''$ stainless steel rods to drive motors 15 and 25 respectively. These rotatable parts of the apparatus were adapted for high vacuum by use of O-ring type vacuum fittings.

Polymerization chamber 1 comprised a $\frac{1}{2}''$ silicone glass (Vycor) tubing which was connected to glass crosses 11 and 21 through O-ring type vacuum fittings.

Figure 6:
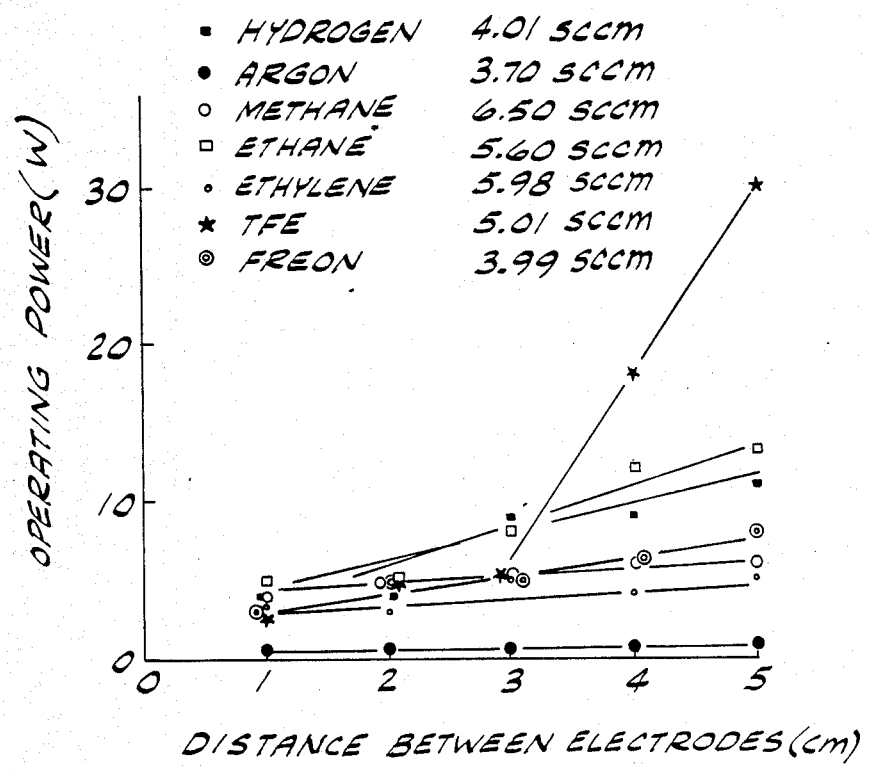
FIG. 6 presents a series of plots of requisite operating power as a function of capacitor electrode separation for various monomers at designated flow rates.

Preparatory to carrying out the glow discharge polymerization coating process, a series of tests were run to determine the requisite operating power as a function of the distance between the electrodes 5 and 7. Set forth in FIG. 6 are plots of the data obtained for various monomers and inert gases at designated flow rates. Based on the results set forth in FIG. 6, a 2 cm gap was selected for coating operations.

Approximately 10 meters of Silastic tubing was wrapped around reel 11 with one end of the tube being connected to the aperture in the reel for communication with vacuum system 31. Both vacuum systems were then activated to reduce the pressure, both inside the tubing and in the region in the apparatus on the outside of the tubing, to approximately $10^{-3}$ torr. Tetrafluorethylene was admitted into the interior of the tubing via conduit 27 and spool 23 at a flow rate of 0.113 sccm, and the radio frequency generator was started and operated at a power input of 20 watts. A Tesla coil was used to initiate plasma polymerization. During the polymerization process the tubing was passed through the glow discharge zone at a velocity of 3.0 to 5.0 mm/sec. Both forward and reflected power was detected using a Microwave Equipment Company radio frequency power meter connected to the load.

Figure 7:
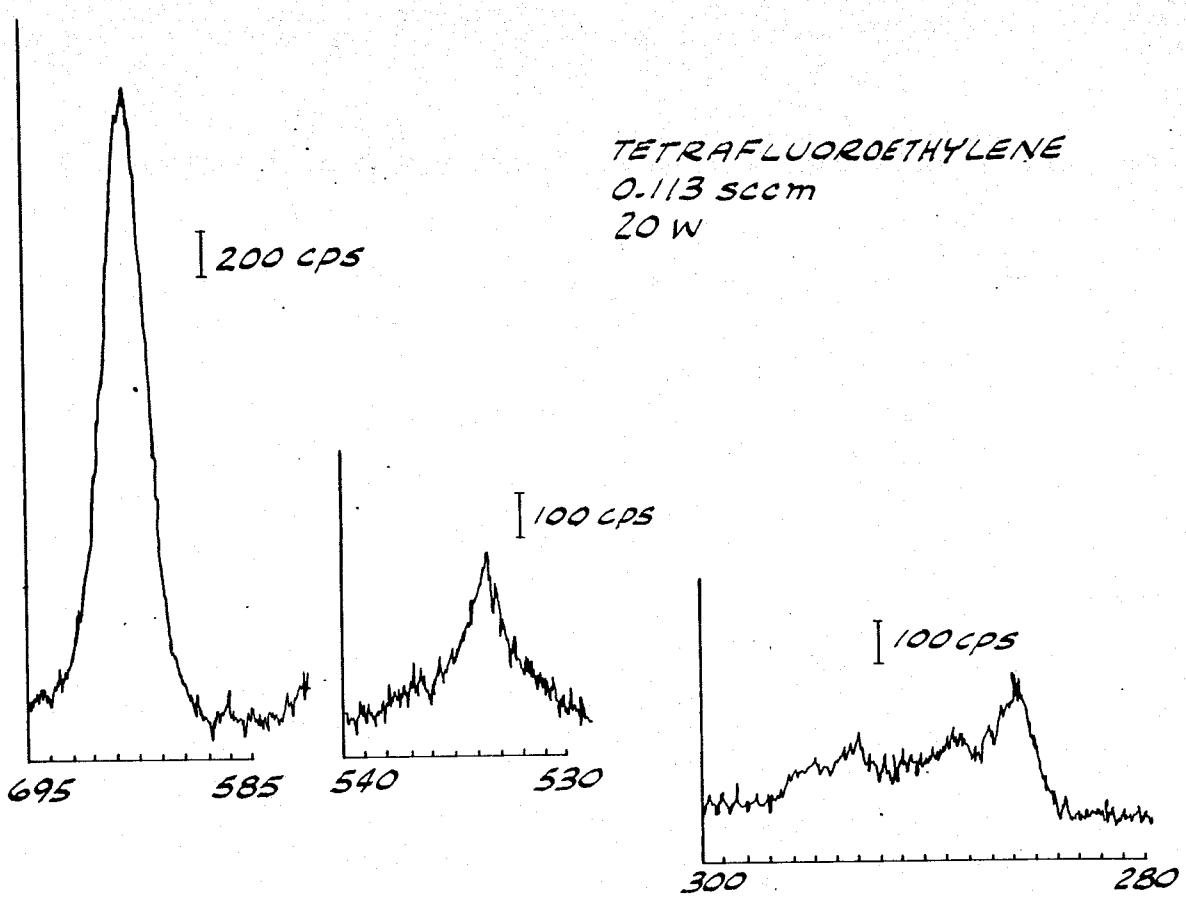
FIG. 7 sets forth spectra for $F_{ls}$, $O_{ls}$, and $C_{ls}$ obtained by electron spectrometric analysis of glow discharge polymerized tetrafluoroethylene on the interior surface of silicone rubber tubing where polymerization was carried out at a monomer flow rate of 0.113 sccm and a power input of 20 watts.

After coating was completed the coating obtained was subjected to electron spectroscopy for chemical analysis (ESCA). Set forth in FIG. 7 are the ESCA spectra for the polymer coatings produced in accordance with this example. It may be seen that the $C_{ls}$ spectra of FIG. 7 have peaks at 295 eV, 293 eV, 288.5 eV, and 286 eV, peaks which can be assigned to $CF_3$, $CF_2$, CF and C respectively. The tetrafluorethylene plasma polymer has a strong fluorine peak at 700 eV and a relatively weak oxygen peak at 533.5 eV.

EXAMPLES 2 to 8

Using the apparatus and method generally described in Example 1, the interior of 3.3 mm I.D., 4.6 mm O.D. Silastic tubing was coated by glow discharge polymerization of tetrafluorethylene under a series of different combinations of conditions. In each case, the polymeric coating obtained was subjected to electron spectroscopy chemical analysis as described in Example 1. Set forth in Table I are monomer flow rates, coating times, input energy per unit weight of monomer, and elemental composition data for the coatings of Examples 2 to 8.

TABLE I

| Example Number | Flow Rate (sccm) | Coating Time (seconds) | Power (watts) | W/FM (J/kg) | Corrected Peak Intensity $\times 10^4$ counts eV $O_{1s}$ | $C_{1s}$ | $F_{1s}$ | Elemental Ratio $O_{1s}/C_{1s}$ | $F_{1s}/C_{1s}$ |
|---|---|---|---|---|---|---|---|---|---|
| 2 | 0.113 | 8.6 | 10 | $1.19 \times 10^9$ | 0.859 | 3.51 | 2.45 | 0.245 | 0.698 |
| 3 | 0.113 | 4.4 | 10 | $1.19 \times 10^9$ | 0.859 | 3.14 | 1.02 | 0.274 | 0.516 |
| 4 | 0.113 | 10.0 | 20 | $1.77 \times 10^9$ | 0.910 | 4.35 | 3.37 | 0.209 | 0.775 |
| 5 | 0.115 | 14 | 14 | $1.63 \times 10^9$ | 0.814 | 3.74 | 3.49 | 0.218 | 0.933 |
| 6 | 0.115 | 5 | 14 | $1.63 \times 10^9$ | 0.843 | 3.77 | 2.33 | 0.224 | 0.618 |
| 7 | 0.331 | 3 | 10 | $4.05 \times 10^8$ | 0.827 | 3.68 | 2.88 | 0.225 | 0.783 |
| 8 | 0.331 | 3 | 6 | $2.40 \times 10^8$ | 0.814 | 3.68 | 2.32 | 0.221 | 0.630 |

Figure 8:
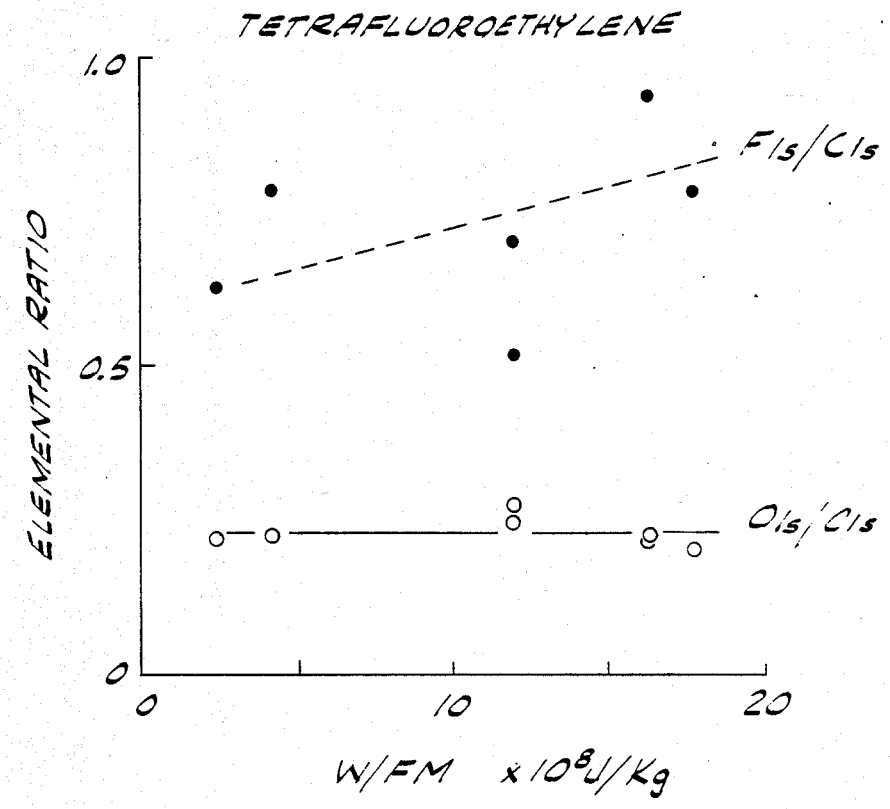
FIG. 8 is a plot of $F_{ls}/C_{ls}$ ratio and $O_{ls}/C_{ls}$ ratio as a function of energy input per unit weight of monomer in the glow discharge polymerization of tetrafluoroethylene on the inside surface of silicone rubber tubing.

From the data in Table I it may be seen that there is no significant change in the elemental ratio of $O_{ls}/C_{ls}$ as the composite plasma polymerization parameter W/FM varies whereas a slight increase in the elemental ratio $F_{ls}/C_{ls}$ is observed as the value of W/FM increases. The elemental ratios $F_{ls}/C_{ls}$ and $O_{ls}/C_{ls}$ for the TFE plasma polymers of Examples 2 to 9 are plotted against the composite parameter W/FM in FIG. 8. Under the plasma polymerization conditions used in these examples, plasma polymers which have a moderate fluorine atom content and a relatively low oxygen atom content are formed from the tetrafluorethylene monomer.

EXAMPLES 9 to 11

Using the apparatus and method generally described in ExampQe 1, 3.3 mm I.D., 4.6 mm O.D. Silastic tubing was coated on its interior wall by glow discharge polymerization of hexafluoroethane. Monomer flow rate, coating time, discharge power W/FM, and electron spectroscopy chemical analyses of the hexafluoroethane plasma polymer coating are set forth in Table II.

TABLE II

| Example Number | Flow Rate (sccm) | Coating Time (seconds) | Power (watts) | W/FM (J/kg) | Corrected Peak Intensity $\times 10^4$ counts eV $O_{1s}$ | $C_{1s}$ | $F_{1s}$ | Elemental Ratio $O_{1s}/C_{1s}$ | $F_{1s}/C_{1s}$ |
|---|---|---|---|---|---|---|---|---|---|
| 9 | 0.266 | 4 | 10 | $3.65 \times 10^8$ | 0.865 | 3.66 | 3.42 | 0.236 | 0.934 |
| 10 | 0.266 | 4 | 15 | $5.48 \times 10^8$ | 1.04 | 3.55 | 2.51 | 0.293 | 0.707 |

TABLE II-continued

| Example Number | Flow Rate (sccm) | Coating Time (seconds) | Power (watts) | W/FM (J/kg) | Corrected Peak Intensity $\times 10^4$ counts eV $O_{1s}$ | $C_{1s}$ | $F_{1s}$ | Elemental Ratio $O_{1s}/C_{1s}$ | $F_{1s}/C_{1s}$ |
|---|---|---|---|---|---|---|---|---|---|
| 11 | 0.266 | 4 | 25 | $9.13 \times 10^8$ | 0.814 | 2.87 | 1.89 | 0.284 | 0.658 |

Figure 9:
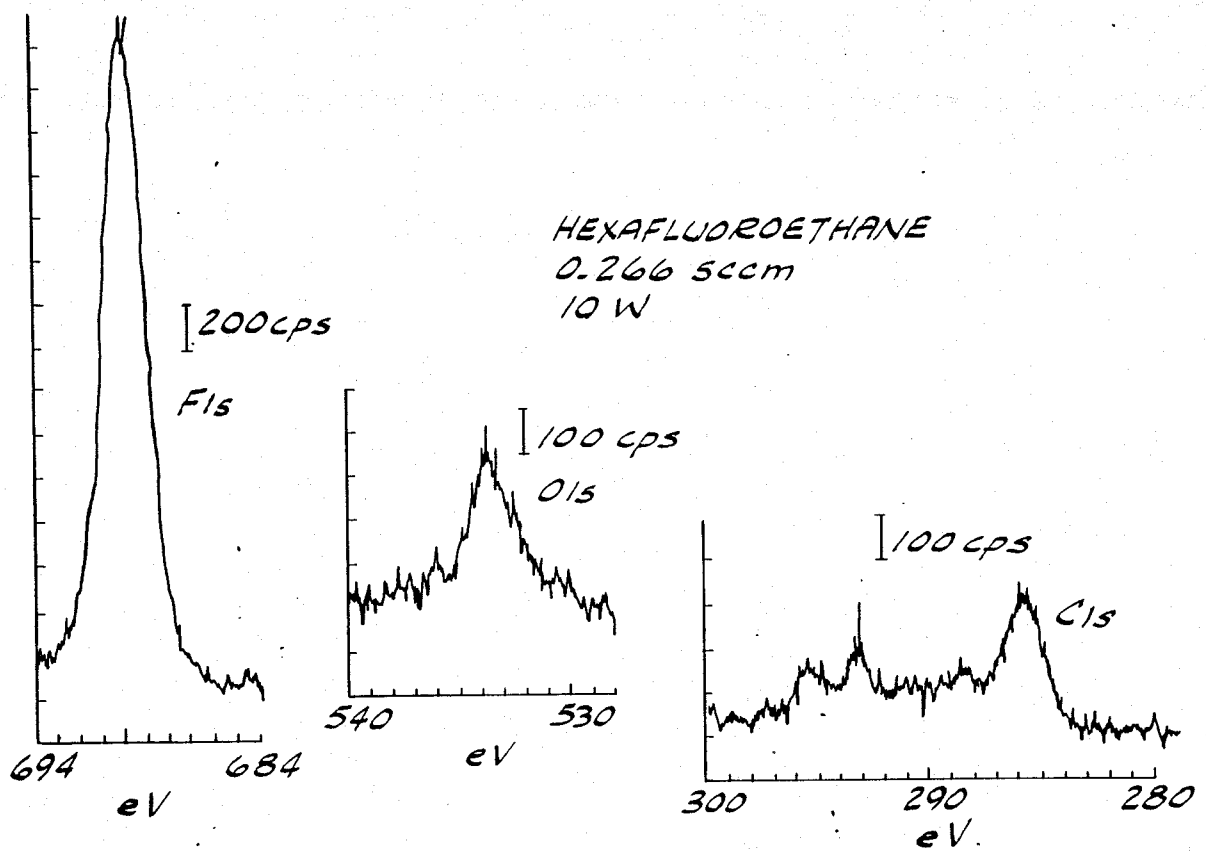
FIG. 9 sets forth ESCA spectra for $F_{ls}$, $O_{ls}$, and $C_{ls}$ obtained by electron spectrometric analysis of glow discharge polymerized hexafluoroethane on the interior surface of silicone rubber tubing where polymerization was carried out at a monomer flow rate of 0.266 sccm and a power input of 10 watts.

Set forth in FIG. 9 are the ESCA spectra for the hexafluoroethane plasma polymer of Example 9. In FIG. 9 the $C_{ls}$ spectra for the hexafluoroethane plasma polymers are seen to have peaks at 285 eV for $CF_3$, 293 eV for $CF_2$, 288.5 eV for CF and 286 eV for C, the same peaks observed for the tetrafluorethylene plasma polymer. A sharp fluorine peak at 700 eV and weak oxygen peak at 533.5 eV are also seen in FIG. 9. As indicated in Table II, the hexafluoroethane plasma polymer prepared at a low discharge power ($W/FM = 3.65 \times 10^8$) exhibits higher fluorine atom content and lower oxygen atom content than the plasma polymers prepared at higher discharge power.

Figure 10:
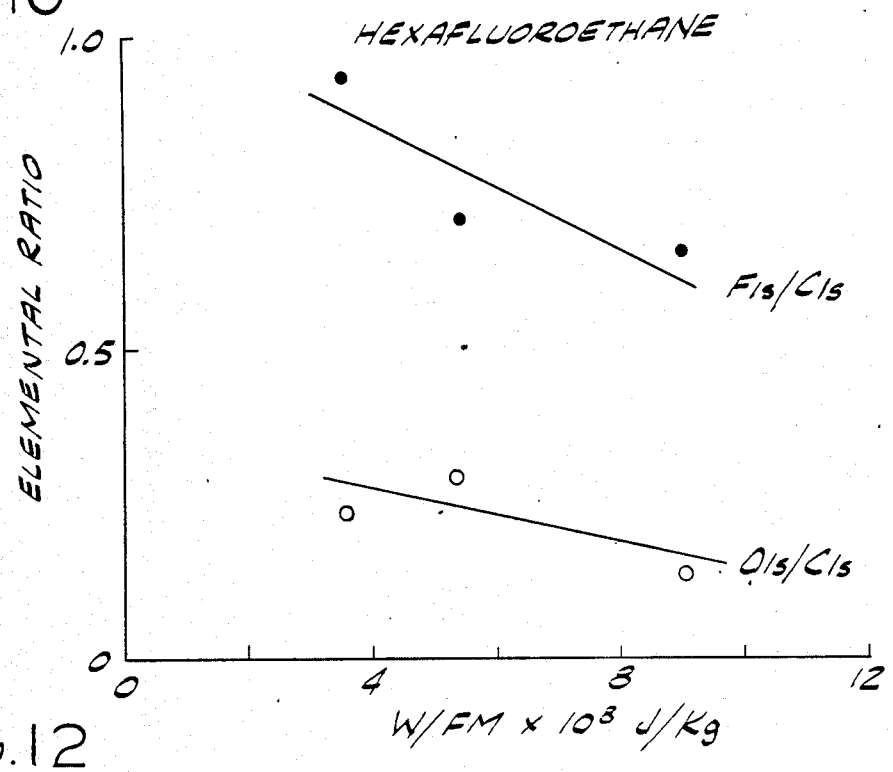
FIG. 10 is a plot of elemental ratio as a function of energy input per unit weight of monomer in the glow discharge polymerization of hexafluoroethane on the interior surface of silicone rubber tubing.

Set forth in FIG. 10 are plots of the elemental ratios $F_{ls}/C_{ls}$ and $O_{ls}/C_{ls}$ as a function of the composite parameter W/FM. It appears that the chemical structure of the polymer formed from hexafluoroethane may be more sensitive to variation with discharge power as compared to the polymer formed by plasma polymerization of tetrafluorethylene in the range of glow discharge polymerization conditions studied in this example.

EXAMPLE 12

Using the method and apparatus generally described in Example 1, 3.3 mm I.D., 4.6 mm O.D. Silastic tubing was interiorly coated by glow discharge polymerization of a mixture of hexafluoroethane and hydrogen. The flow rate of hexafluorethane was 3.50 SCCM and that of hydrogen was 2.15 SCCM. In the coating procedures of this example, both discharge power and residence time of the tubing in the glow discharge polymerization zone (coating time) were varied, with consequent variation in the ESCA spectra of the plasma polymerized coating obtained on the interior wall of the silastic tubine. A coating prepared at low discharge power and residence time up to 30 seconds exhibited a chemical structure similar to those obtained for tetrafluorethylene or hexafluoroethane by itself, each of which exhibits a strong fluorine peak at 700 eV and weak oxygen peak at 533.5 eV. However, hexafluoroethane/hydrogen glow discharge polymers formed at higher discharge power, i.e., 30 watts, and a short residence time of 2 to 4 seconds, exhibited a significantly different chemical structure, as shown in FIG. 11.

Figure 11:
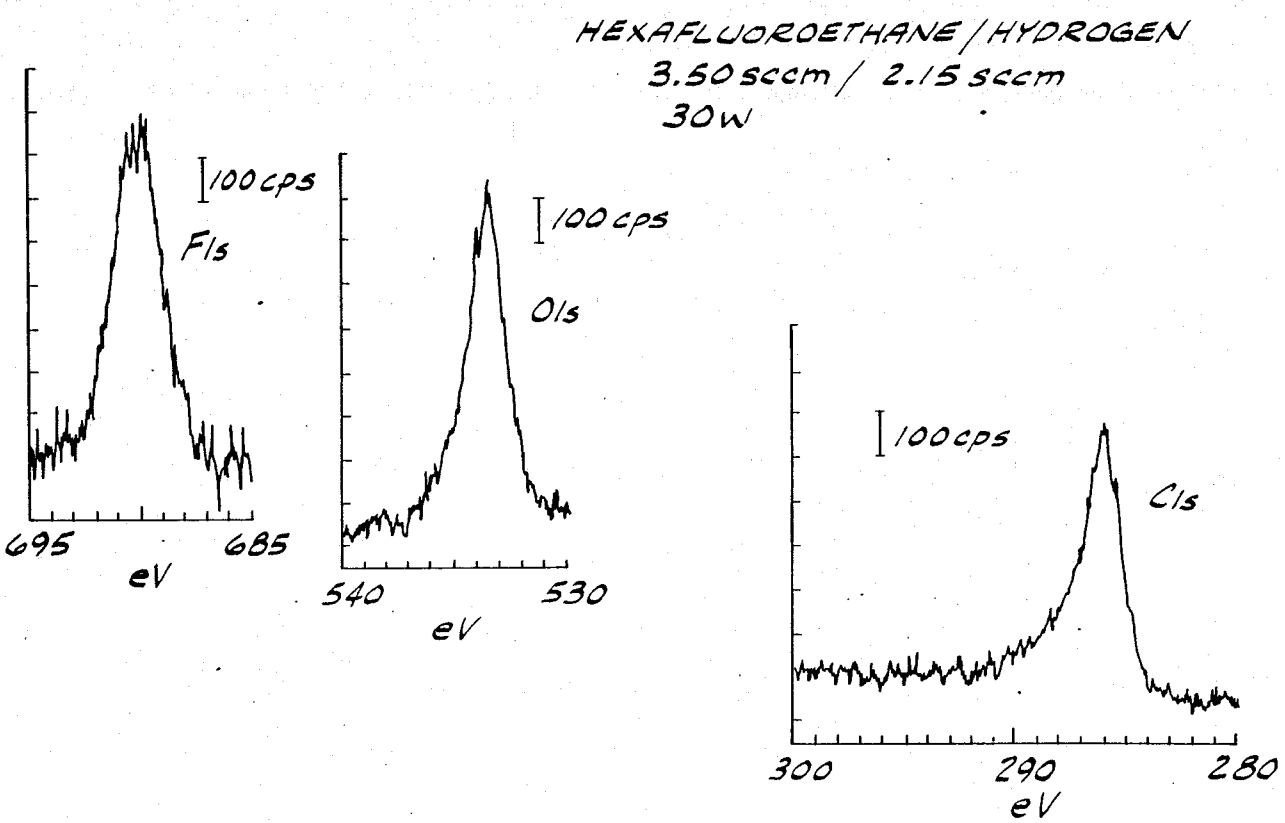
FIG. 11 sets forth ESCA spectra for $F_{ls}$, $O_{ls}$ and $C_{ls}$, for the polymer deposit obtained upon the glow discharge polymerization of a mixture of hexafluoroethane (3.50 sccm) and hydrogen (2.15 sscm) on the interior surface of silicone rubber tubing at a power input of 30 watts.

In the spectra of FIG. 11 a weak fluorine peak is observed at 700 eV and a relatively strong and sharp oxygen peak at 533.5 eV. The $C_{ls}$ spectrum has a singlet peak at 286 eV with a wide shoulder on the high electron volt side. This contrasts with the spectra for plasma polymers of tetrafluorethylene, hexafluoroethane and hexafluoroethane/hydrogen prepared at low discharge power, all of which have four peaks for the $C_{ls}$ at 285 eV, 293 eV, 288.5 eV and 286 eV, respectively.

Figure 12:
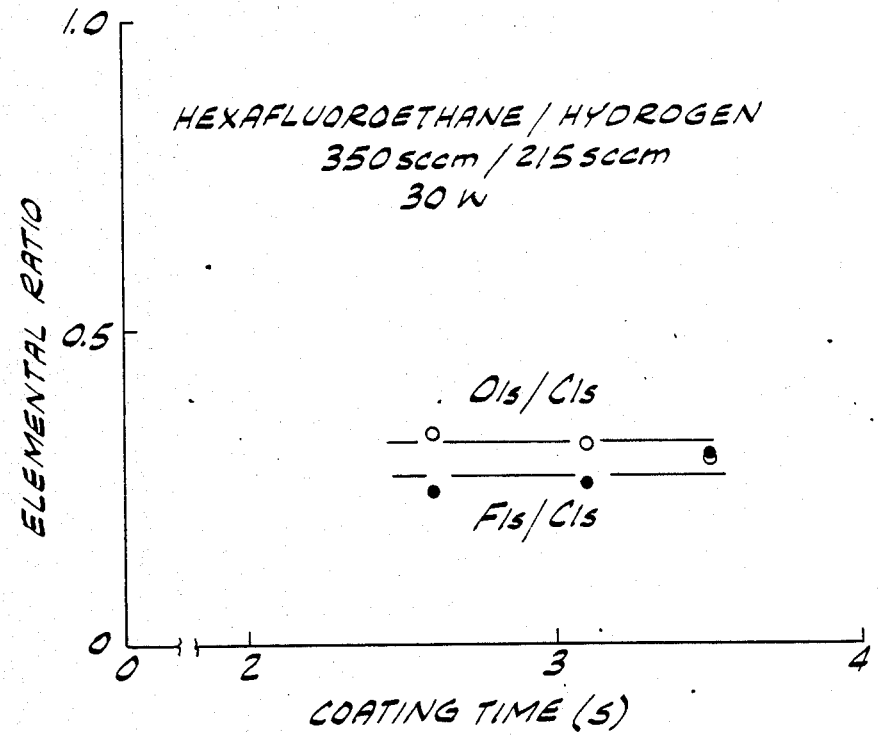
FIG. 12 is a plot of elemental ratio as a function of coating time for the glow discharge polymerization of a mixture of hexafluoroethane (3.50 sccm) and hydrogen (2.15 sccm) on the interior surface of silicone rubber tubing at a power input of 30 watts.

Set forth in FIG. 12 is a plot of elemental ratios against coating time (residence time) for coating of the interior wall of Silastic tubing by glow discharge copolymerization of hexafluoroethane and hydrogen. As illustrated in this plot, elemental ratio is not influenced by coating time at high power input.

Figure 13:
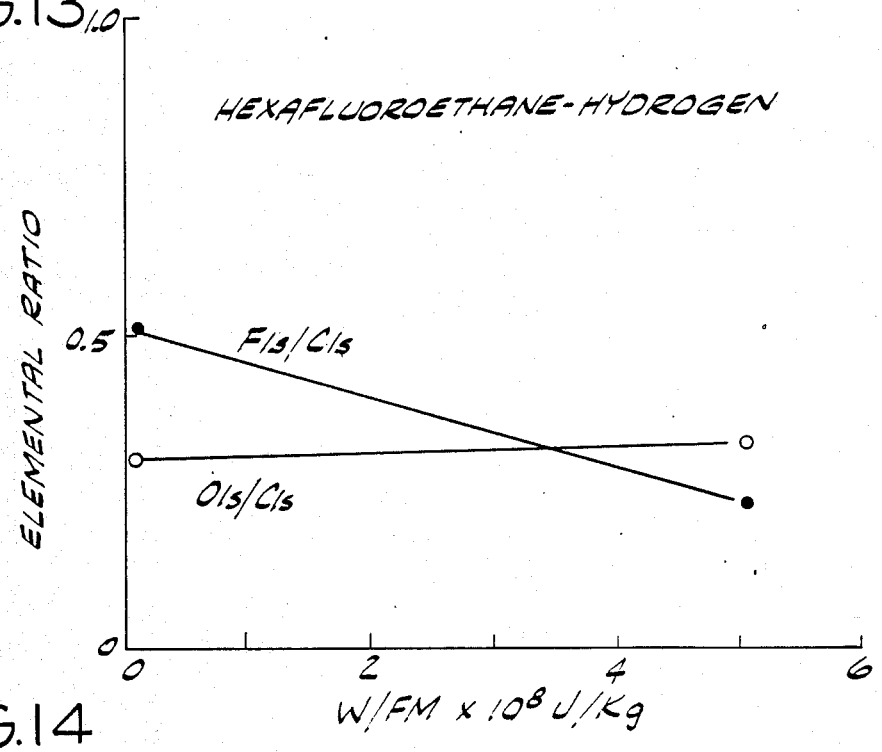
FIG. 13 is a plot of elemental ratio as a function of energy input per unit weight of a monomer in the glow discharge polymerization of a mixture of hexafluoroethane and hydrogen on the interior surface of silicone rubber tubing.

Set forth in FIG. 13 is a plot of elemental ratio against W/FM for the glow discharge copolymerization of hexafluoroethane and hydrogen on the interior wall of Silastic tubing. This plot illustrates the effect of change in power input on the chemical composition of the glow discharge polymer. It may be noted that, even at very low W/FM levels, the hexafluoroethane/hydrogen plasma polymer has the lowest $F_{ls}/C_{ls}$ ratios and the highest $O_{ls}/C_{ls}$ ratios of any of the polymers of Examples 1 through 12.

EXAMPLES 13 to 15

Using the method and apparatus generally described in Example 1, the interior wall of Silastic tubing was coated by glow discharge polymerization. In Example 13, tetrafluoroethylene monomer was passed into the glow discharge polymerization zone at a rate of 1.7 sccm, the power was 16.5 watts, and runs were made at five separate pulling rates. The thickness of the polymeric coatings obtained were measured using scanning electron micrographs and the measurements obtained were plotted against residence time. These data are set forth in FIG. 14.

Figure 15:
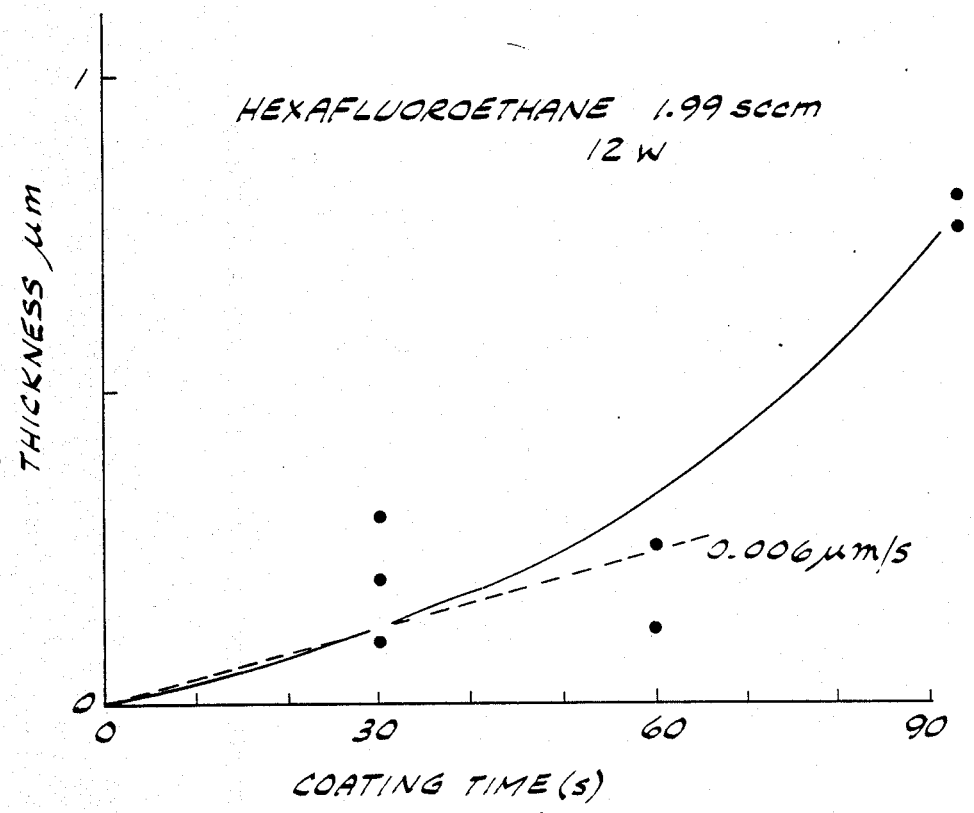
FIG. 15 is a plot of coating thickness vs. coating time in the glow discharge polymerization of hexafluoroethane on the interior surface of silicone rubber tubing at a monomer flow rate of 1.99 sccm and a power input of 12 watts.

FIG. 15 shows comparable data for coating the interior of Silastic tubing by glow discharge polymerization of hexafluoroethane at a monomer flow of 1.99 sccm, and a discharge power of 12 watts. Three different residence times were utilized.

Figure 16:
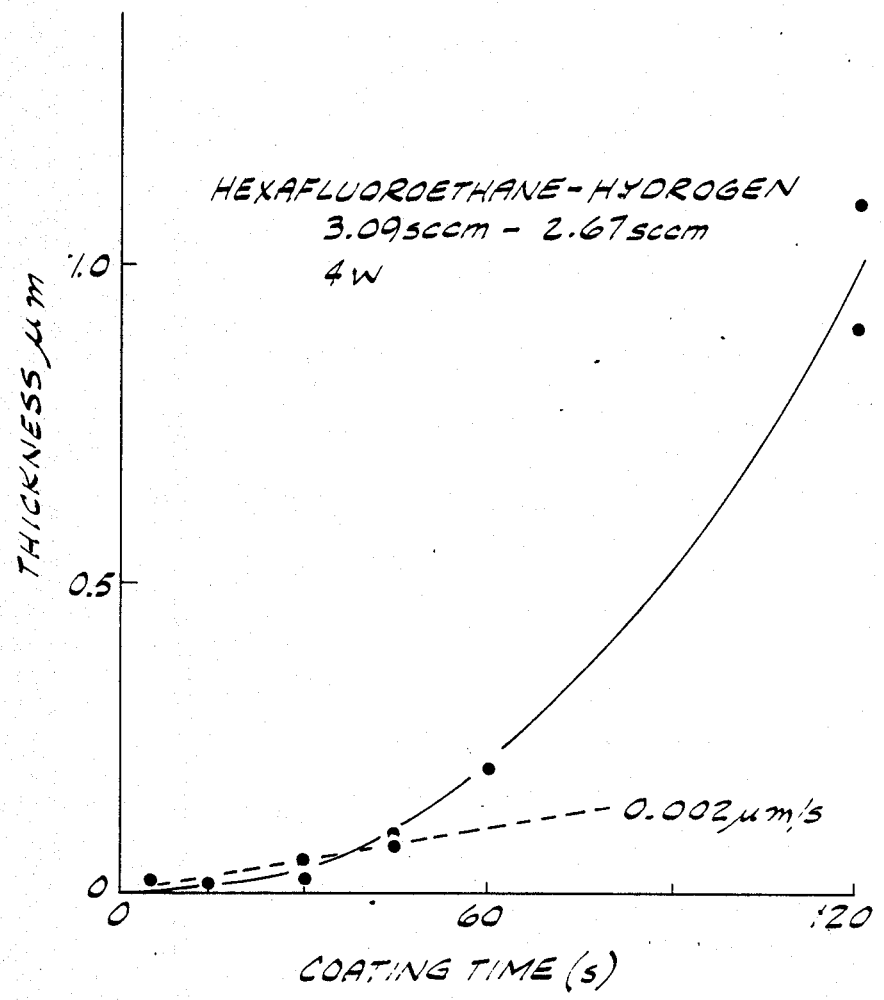
FIG. 16 is a plot of coating thickness versus coating time for the glow discharge polymerization of a mixture of hexafluoroethane (3.09 sccm) and hydrogen (2.67 sccm) on the interior surface of silicone rubber tubing at a power input of 4 watts.

FIG. 16 represents a plot of comparable data for coating the interior of Silastic tubing by glow discharge polymerization of a mixture of hexafluoroethane (3.09 sccm) and hydrogen (2.67 sccm) at a power input of 4 watts.

Figure 14:
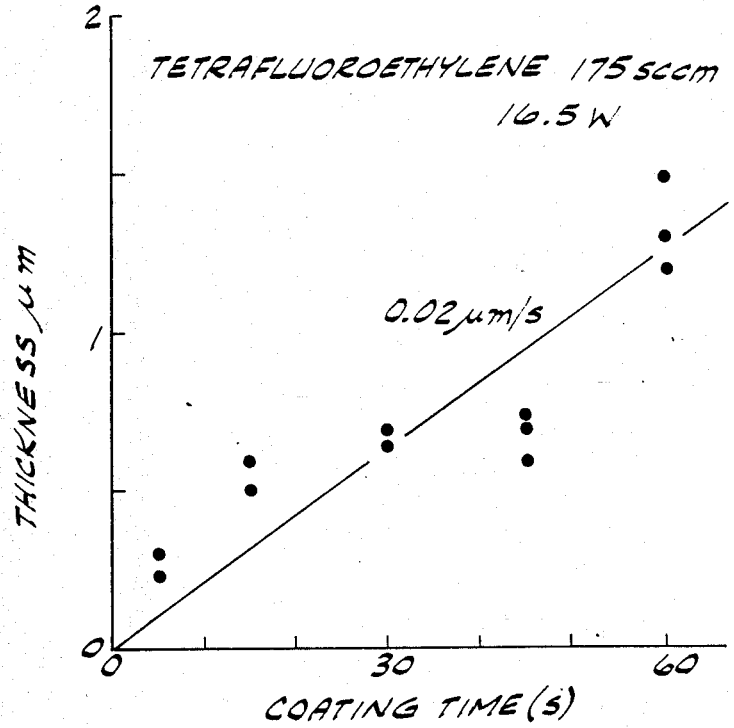
FIG. 14 is a plot of coating thickness as a function of coating time in the glow discharge polymerization of tetrafluoroethylene on the interior surface of silicone rubber tubing at a monomer flow rate of 1.75 sccm and a power input of 16.5 watts.

From the plots of FIGS. 14–16, it may be seen that coating thickness is an essentially linear function of residence time, up to a residence time of about 60 seconds. Thus, deposition rates may be calculated from the slopes of these plots. Flow rate, power input, W/FM and deposition rates for Examples 13 through 15 are summarized in Table III.

TABLE III

| Example Number | Monomer | Flow Rate (sccm) | Power (watts) | W/FM (J/kg) | Deposition Rate (μm/s) |
|---|---|---|---|---|---|
| 13 | Tetrafluoroethylene | 1.75 | 16.5 | $1.26 \times 10^8$ | 0.02 |
| 14 | Hexafluoroethane | 1.99 | 12 | $5.86 \times 10^7$ | 0.006 |
| 15 | *Hexafluoroethane/Hydrogen | 3.09/2.67 | 4 | $1.24 \times 10^7$ | 0.002 |

*Mixture of hexafluoroethane and hydrogen (% of hexafluoroethane: 53.6%)

From the data of these examples, it may be noted that the rates of plasma polymer deposition are very high compared to the deposition rates obtained in plasma polymer systems previously known to the art. The relatively high rates obtained in accordance with the method of the invention were anticipated as a result of restricting the glow discharge zone to a small volume (3.3 mm I.D. by 20 mm long) and providing a relatively high surface-to-volume ratio. Assuming a 100% yield of polymerization in the glow region, a calculated deposition rate of 27 microns/second could be expected for tetrafluroethylene plasma polymerization where the monomer flow rate is 1 sscm and polymer density is 1.3 g/cc. Although actual deposition rates are not as high as the theoretical values, they do substantially exceed the rates generally realized by other methods, and thus high deposition rate is a significant feature of the method of the invention where it is carried out using a relatively small-volume plasma polymerization zone. As a result of these rapid deposition rates, it may in some instances be feasible and desirable to operate at relatively high linear tubing speed and/or to retard the deposition rate by diluting the monomer gas with an inert gas such as helium, neon or argon.

EXAMPLES 16 to 19

A series of plasma polymerizations was carried out for the deposition of a tetrafluoroethylene plasma polymer on the internal surface of Silastic tubing. The method generally described in Example 1 was utilized, with varying combinations of discharge power, tubing residence time in the glow discharge zone, and tetrafluoroethylene monomer flow rate. Polymerization conditions for Examples 16 to 19 are set forth in Table IV.

TABLE IV

| Example Number | Residence Time (sec) | Discharge Power (watts) | Tetrafluoroethylene Flow Rate (sccm) |
|---|---|---|---|
| 16 | 5 | 14 | 0.115 |
| 17 | 14 | 14 | 0.115 |
| 18 | 3 | 6 | 0.331 |
| 19 | 3 | 10 | 0.331 |

Scanning electron micrographs of the deposited polymer revealed that in Examples 16 to 19 a knitted fibrous structure was formed on the ridgelike surface of the uncoated Silastic. Thus, under the plasma polymerization conditions of these examples, the polymer layer obtained conformed closely to the macroscopic topography of the underlying Silastic tube wall.

EXAMPLES 20 to 22

Tetrafluoroethylene plasma polymer coatings were provided on the interior surface of Silastic tubing using the method generally described for Examples 16 to 19, under the combinations of conditions set forth in Table V.

TABLE V

| Example Number | Residence Time (sec) | Discharge Power (watts) | Monomer Flow Rate (sccm) |
|---|---|---|---|
| 20 | 4.4 | 10 | 0.113 |
| 21 | 8.6 | 10 | 0.113 |
| 22 | 10 | 20 | 0.1132 |

Scanning electron micrographs of the polymer coatings of these examples again exhibited a knitted fibrous surface structure that conformed closely to the topography of the underlying Silastic.

EXAMPLES 23 to 26

Tetrafluoroethylene plasma polymer was deposited on the interior wall of Silastic tubing utilizing the method described for Examples 16 to 19, but under the combination of conditions set forth in Table VI.

TABLE VI

| Example Number | Residence Time (sec) | Discharge Power (watts) | Monomer Flow Rate (sccm) |
|---|---|---|---|
| 23 | 1 | 16 | 1.75 |
| 24 | 10 | 16 | 1.75 |
| 25 | 20 | 16 | 1.75 |
| 26 | 60 | 16 | 1.75 |

Scanning electron micrographs revealed that the polymer deposits of Examples 23 to 26 contained stress cracks whose formation resulted from the fact that the coating thickness exceeding a critical value.

EXAMPLES 27 to 35

Hexafluoroethane plasma polymer coatings were deposited on the interior surfaces of lengths of Silastic tubing. The method generally described for Examples 16 to 19 was utilized, but polymerization was carried out under the conditions of Table VII.

TABLE VII

| Example Number | Residence Time (sec) | Discharge Power (watts) | Monomer Flow Rate (sccm) |
|---|---|---|---|
| 27 | 4 | 10 | 0.266 |
| 28 | 4 | 15 | 0.266 |
| 29 | 4 | 25 | 0.266 |
| 30 | 3.6 | 11 | 0.355 |
| 31 | 6.3 | 11 | 0.355 |
| 32 | 27 | 11 | 0.355 |
| 33 | 15 | 12 | 1.99 |
| 34 | 30 | 12 | 1.99 |
| 35 | 60 | 12 | 1.99 |

Scanning electron micrographs showed a knitted fibrous structure for the polymer deposits of Examples 27 and 28. Filling of the knitted fibrous structure resulted when the discharge power was increased at constant residence time and monomer flow rate (Example 29).

Scanning electron micrographs for Examples 30 to 32 revealed a ridgelike structure for a short residence time of 3.6 seconds, a knitted fibrous structure for a residence time of 6.3 seconds and, for the relatively long residence time of 27 seconds, a relatively thick deposit in which the knitted fibrous structure had disappeared and cracks had developed.

Where the residence time was 30 seconds, scanning electron micrographs for the polymer deposits of Examples 33 to 35 reflected a filled knitted fibrous surface structure containing cracks. At a residence time of 60 seconds, a thick bulky coating layer was formed.

EXAMPLES 36 to 42

The work of Examples 16 to 35 was repeated using a monomer mixture of hexafluoroethane and hydrogen. Conditions were varied as set forth in Table VIII.

TABLE VIII

| Example Number | Residence Time (sec) | Discharge Power (watts) | Flow Rate (sccm) Hexa-fluoroethane | Flow Rate (sccm) Hydrogen |
|---|---|---|---|---|
| 36 | 1 | 4 | 3.09 | 2.67 |
| 37 | 30 | 4 | 3.09 | 2.67 |
| 38 | 60 | 4 | 3.09 | 2.67 |
| 39 | 120 | 4 | 3.09 | 2.67 |
| 40 | 2.6 | 30 | 3.50 | 2.15 |
| 41 | 3.1 | 30 | 3.50 | 2.15 |
| 42 | 3.5 | 30 | 3.50 | 2.15 |

Scanning electron micrographs of the glow discharge polymerization product layers of Examples 36 to 39 revealed development of cracks when residence time exceeded 30 seconds at a glow discharge power of 4 watts. At the high discharge power of 30 watts utilized in Examples 40 to 42, cracks began to form at even a very short residence time of 3 seconds (Example 41). At a residence time of 2.6 seconds, the ridge surface structure of the Silastic was filled by the plasma polymerization process. When the residence time was increased to 3 seconds per Example 41, holes were observed in the filled knitted fibrous structure. A further increase in residence time (Example 42) produced cracks in the completely filled knitted structure.

EXAMPLES 43 to 47

In order to determine the integrity of the plasma polymer layer, a series of dye tests was carried out on tetrafluoroethylene plasma polymer layers deposited on the internal surface of Silastic tubing in the manner generally described for Examples 16 to 19. Set forth in Table IX are the polymerization conditions for the polymer layers produced in accordance with Examples 43 to 47.

In the dye test, the coated internal surface of the Silastic silicone rubber tubing was exposed for 30 minutes to a solution of Sudan red dye in an organic solvent. After 30 minutes of exposure, the dye solution was removed and the coated internal surface of the Silastic tubing rinsed with acetone and water. Because silicone is highly permeable to nonaqueous liquids, the dye readily penetrates into and stains the Silastic tubing wall at any point in which there is a defect in the tetrafluoroethylene plasma polymer coating. Set forth in Table IX are the results of the staining tests for Examples 43 to 47.

TABLE IX

| Example Number | Flow Rate (sccm) | Coating Time (seconds) | Operational Power (watts) | W/FM J/kg | Dye Test |
|---|---|---|---|---|---|
| 43 | 0.113 | 8.6 | 10 | $1.19 \times 10^9$ | not stained |
| 44 | 0.113 | 4.4 | 10 | $1.19 \times 10^9$ | not stained |
| 45 | 0.113 | 10 | 20 | $1.77 \times 10^9$ | not stained |
| 46 | 0.115 | 14 | 14 | $1.22 \times 10^9$ | lightly stained |
| 47 | 0.115 | 5 | 14 | $1.22 \times 10^9$ | not stained |

In Example 46, the relatively long residence time of 14 seconds apparently resulted in the formation of small cracks which allowed a limited penetration of dye and, therefore, light staining of the underlying Silastic tubing.

EXAMPLES 48 to 57

Using the method described for Examples 43 to 47, dye penetration tests were carried out for plasma polymer coatings produced under varying conditions by glow discharge polymerization of hexafluoroethane on the interior surface of Silastic tubing. The conditions under which the polymer layers were deposited and the results of the dye penetration tests are set forth in Table X.

TABLE X

| Example Number | Flow Rate (sccm) | Coating Time (seconds) | Operational Power (watts) | W/FM J/kg | Dye Test |
|---|---|---|---|---|---|
| 48 | 0.355 | 27 | 11 | $3.01 \times 10^8$ | not stained |
| 49 | 0.355 | 6.3 | 11 | $3.01 \times 10^8$ | not stained |
| 50 | 0.355 | 43.6 | 11 | $3.01 \times 10^8$ | not stained |
| 51 | 0.155 | 15.9 | 10 | $6.26 \times 10^8$ | lightly stained |
| 52 | 0.155 | 5.4 | 10 | $6.26 \times 10^8$ | not stained |
| 53 | 0.155 | 3.1 | 10 | $6.26 \times 10^8$ | not stained |
| 54 | 0.155 | 16.8 | 20 | $1.25 \times 10^9$ | lightly stained |
| 55 | 0.155 | 7.0 | 20 | $1.25 \times 10^9$ | not stained |
| 56 | 0.155 | 4.8 | 20 | $1.25 \times 10^9$ | not stained |
| 57 | 0.155 | 11.6 | 70 | $4.39 \times 10^9$ | not stained |

Consistent with the results reported for Examples 16 to 42, the combination of high discharge power and high flow rate resulted in formation of cracks in the polymer coating layer obtained by glow discharge polymerization of both tetrafluoroethylene and hexafluoroethane. At relatively low flow rates, cracks were associated only with relatively high residence times.

All of these examples illustrate that coatings of very high integrity can be readily obtained by control of residence time, power input and monomer flow rate within the ranges discussed hereinabove.

EXAMPLE 58

Using the method and apparatus described in Example 1, the interior surface of 3 mm I.D. Silastic tubing was provided with a barrier coating of glow discharge polymerized tetrafluoroethylene. A length of this interiorly coated tubing was tested for thrombogenic properties by methods described by Hanson et al., "In vivo Evaluation of Artificial Surfaces with a Nonhuman Primate Model of Arterial Thrombosis", *J. Laboratory and Clinical Medicine,* Vol. 95, pp. 289–304, February 1980.

In accordance with the Hanson et al. method, a cannula comprising a length of interiorly coated Silastic tubing was surgically implanted into a male baboon as an arterialvenous shunt. The cannula was provided with Dacron sewing cuffs, sterilized by autoclaving, and implanted between the femoral artery and vein of the baboon. The cannula was allowed to remain in the animal for 4 to 6 weeks, during which observations were made on the rate of platelet decay in the animal's circulatory system.

In accordance with the method described in detail by Hanson et al., $^{51}$chromium radiolabeled platelets were intravenously injected into the baboon and periodic measurement made of the $^{51}$chromium content of the blood. This was done by taking a 3 ml sample of whole blood collected in EDTA, lysing it with 0.5 ml concentated sodium dodecyl sulfate, and counting for radioactivity utilizing a gamma spectrometer.

A comparison of the rate of platelet decay in control baboons with the rate of decay in the baboon in which the tetrafluoroethylene-coated Silastic tubing cannula shunt had been installed indicated no significant differences. Accordingly, it was established that the tetrafluoroethylene coating on the interior wall of the tubing was free from any thrombogenic characteristics.

EXAMPLES 59 to 65

Using the apparatus and method generally described in Example 1, Silastic tubing was interiorly coated by plasma polymerization of various monomers. In the course of polymerization, monomer flow rate was controlled using a Tylan flow controller. Measurements were taken of both forward and reflected power, pulling rate, residence time, pressure at the tubing inlet, and pressure at the tubing outlet. To determine the integrity of the polymeric coating deposited on the interior surface of the tubing, the coating was tested in accordance with the dye test described above with respect to Examples 43 to 47.

For purposes of comparison, the system was also operated in the absence of a polymer-forming gas. In one instance, nitrogen was flowed through the tubing, and in the other case argon was flowed through the tubing. Results of the operations of Examples 59 to 65 are set forth in Table XI, together with the comparative runs using nitrogen and argon.

TABLE XI

| Example Number | Monomer | Flow Rate*1 (sccm) | Discharge*2 Power (watts) | Pulling Rate (cm/min) | Residence Time (sec) | Pressure Inlet (mtorr) | Pressure Outlet (mtorr) | Dye Test |
|---|---|---|---|---|---|---|---|---|
| 59 | TFE | 0.30 | 10F - 5R, 5 | 32.0 | 3.7 | 1700 | 3.5 | not stained |
| 60 | Freon | 0.30 | 10F - 5R, 5 | 18.6 | 6.4 | 1430 | 3.1 | not stained |
| 61 | Freon-$H_2$*3 | — | 50F - 40R, 10 | 18.6 | 6.4 | 3180 | 5.4 | not stained |
| 62 | Freon-$H_2$*4 | — | 15F - 11R, 4 | 23.0 | 5.2 | 1680 | 3.3 | not stained |
| 63 | Methane | 0.30 | 10F - 8R, 2 | 15.0 | 8.0 | 1730 | 3.3 | not stained |
| 64 | Propylene | 0.30 | 10F - 8.5R, 1.5 | 22.0 | 5.4 | 1100 | 3.9 | not stained |
| 65 | $CF_4$ | 0.30 | 10F - 7.0R, 3 | 22.0 | 5.4 | 1520 | 4.7 | not stained |
| | Non-polymer forming gas | | | | | | | |
| — | Nitrogen | 0.30 | 21F - 9R, 12 | 24.0 | 5.0 | 3010 | 6.3 | stained |
| — | Argon | 0.50 | 10F - 9.5R, 0.5 | 18.0 | 6.7 | 5100 | 9.5 | stained |

*1set value by Tylan flow controller
*2F: forward; R: reflected
*350% freon by volume (freon, $C_2F_6$)
*425% freon by volume (freon, $C_2F_6$)

EXAMPLE 66 to 68

Using the method and apparatus generally described in Example 1, plasma polymerization layers were deposited on the interior surfaces of fifteen-meter lengths of Silastic tubing. In the coating operation, the tubing was pulled through the glow discharge polymerization zone at a rate of 32 cm/min, thus providing a residence time of 3.7 seconds in the 20 mm glow discharge zone. The coating layers obtained were subjected to electron spectroscopy for chemical analysis and were also subjected to the dye test described with respect to Example 43 to 47. For purposes of comparison, the dye test and ESCA tests were also run on the uncoated surface of the Silastic substrate. The results of the tests of these examples are set forth in Table XII.

TABLE XII

| Example Number | Monomer | Flow Rate (sccm) | Power*5 | Dye Test | Atomic Ratio $O_{1s}/C_{1s}$ | $F_{1s}/C_{1s}$ | $Si_{2p}/C_{1s}$ | Atomic % C | O | $Si_{2p}$ | F |
|---|---|---|---|---|---|---|---|---|---|---|---|
| Uncoated*1 | — | — | — | stained | 9.55 | — | 0.72 | 8.9 | 84.8 | 6.3 | — |
| 66*2 | TFE | 0.3 | 5 | not stained | 1.65 | 13.6 | 0.09 | 6.2 | 10.3 | 0.5 | 83.0 |
| 67*3 | TFE | 0.3 | 5 | not stained | 1.76 | 14.6 | 0.10 | 5.7 | 10.1 | 0.6 | 83.6 |
| 68*4 | TFE | 0.3 | 5 | not stained | 1.50 | 12.1 | 0.07 | 6.8 | 10.2 | 0.5 | 82.5 |

*1blank tubing
*2beginning part of coating of 14 meters coated tubing
*3middle part of coating on 14 meters coated tubing
*4end part of coating on 14 meters coated tubing
*5forward power, 10 watts; reflected power 5 watts In view of the above, it will be seen that the several objects of the invention are achieved and other advantageous results attained.

As various changes could be made in the above apparatus, methods and products without departing from the scope of the invention, it is intended that all matter contained in the above description or shown in the accompanying drawings shall be interpreted as illustrative and not in a limiting sense.

What is claimed is:

1. A method for providing a thin, substantially uniform polymeric coating on the inside surface of tubing comprising:

passing flexible tubing constituted of dielectric plastic material through a glow discharge zone, said glow discharge being procuded by reactance coupling utilizing power provided by a radio requency power source; and simultaneously with the movement of said tubing through said glow discharge zone, passing an organic monomer that is subject to glow discharge polymerization through said glow discharge zone in the interior of said tubing while maintaining an absolute pressure of between about 300 and about 900 mtorr in said interior within said zone, thereby effecting glow discharge polymerization of said monomer to form a thin polymeric coating on the inside surface of said tubing.

2. A method for providing a thin substantially uniform athrombogenic polymeric coating on the inside surface of flexible plastic tubing comprising:

passing flexible tubing constituted of a dielectric plastic material through a glow discharge zone, said glow discharge being produced by reactance coupling utilizing power provided by a radio frequency power source;

simultaneously with the movement of said tubing through said glow discharge zone, passing an organic monomer that is subject to glow discharge polymerization through said glow discharge zone in the interior of said tubing while maintaining an absolute pressure of between about 300 and about 900 mtorr in said interior within said zone; and effecting glow discharge polymerization of said monomer to form on the inside surface of said plastic tubing a polymeric coating having a thickness of between about 50 and about 1000 angstroms.

3. A method for providing a thin substantially uniform polymeric coating on the inside surface of tubing comprising:

passing flexible tubing constituted of a dielectric plastic material through a glow discharge zone, said glow discharge being produced by reactance coupling utilizing power provided by a radio frequency power source;

simultaneously with the movement of said tubing through said glow discharge zone, passing an organic monomer that is subject to glow discharge polymerization through said glow discharge zone in the interior of said tubing while maintaining an absolute pressure of between about 300 and about 900 mtorr in said interior within said zone, thereby effecting glow discharge polymerization of said monomer to form a thin polymeric coating having a thickness of between about 50 and 1000 angstroms on the inside surface of said tubing;

maintaining a low absolute pressure in the region around the outside surface of said tubing at the location of the glow discharge zone while polymerization is being carried out for coating the inside surface of the tubing; and passing a monomer through a low pressure region around the outside of the tubing, thereby effecting glow discharge polymerization for applying a thin polymeric coating to the outside surface of the tubing simultaneously with the application of a polymeric coating on the inside surface of the tubing.

4. A method for providing a thin, substantially uniform polymeric coating on the inside surface of flexible plastic tubing comprising:

passing flexible tubing constituted of dielectric plastic material through a glow discharge zone, the entire length of said tubing being within a system evacuated to establish a low absolute pressure outside the tubing as the tubing is passed through said zone, said glow discharge zone being produced by reactance coupling utilizing power provided by a radio frequency power source; and simultaneously with the movement of said tubing through said glow discharge zone, passing an organic monomoer that is subject to glow discharge polymerization through said glow discharge zone in the interior of said tubing while maintaining a low absolute pressure in said interior within said zone, thereby effecting glow discharge polymerization of said monomer to form a thin polymeric coating on the inside surface of said flexible plastic tubing.

5. A method as set forth in claim 4 wherein the pressure inside the tubing at the glow discharge zone is less than about one torr.

6. A method for providing a thin, substantially uniform polymeric coating on the inside surface of flexible plastic tubing comprising:

unwinding from a feed reel flexible tubing comprised of dielectric plastic material, said feed reel being contained within a feed chanber from which said tubing is delivered to a polymerization chamber;

by reactance coupling means, producing a glow discharge zone within said polymerization chamber;

passing said flexible tubing through said glow discharge zone within said polymerization chamber, said glow discharge being produced by reactance coupling utilizing power provided by a radio frequency power source;

simultaneously with the movement of said tubing through said glow discharge zone, passing an organic monomer that is subject to glow discharge polymerization through said glow discharge zone in the interior of said tubing while maintaining a low absolute pressure in said interior within said zone, thereby effecting glow discharge polymerization of said monomer to form a thin polymeric coating on the inside surface of said flexible plastic tubing, thereby forming interiorly coated tubing;

passing the interiorly coated tubing from said polymerization chamber to a receiving chamber containing a receiving reel, the interior of said tubing being in communication with a first evacuation means and a source of said monomer, and the regions of said feed chamber, polymerization chamber and receiving chamber outside of said tubing being in communication with a second evacuation means; and rewinding the coated tubing on the receiving reel.

* * * * *

UNITED STATES PATENT AND TRADEMARK OFFICE

CERTIFICATE OF CORRECTION

PATENT NO. : 4,692,347

DATED : September 8, 1987

INVENTOR(S) : Hirotsuga K. Yasuda

It is certified that error appears in the above-identified patent and that said Letters Patent is hereby corrected as shown below:

Column 1, line 3,

"This Invention was made with government support under Grant No. 5 R01 HL24476-02 awarded by the Department of Health and Human Services. The government has certain rights in the Invention."

Signed and Sealed this

Twenty-seventh Day of February, 1996

*Attest:*

Bruce Lehman

BRUCE LEHMAN

*Attesting Officer*

*Commissioner of Patents and Trademarks*